US005581221A

United States Patent [19]

Kawai et al.

[11] Patent Number: 5,581,221

[45] Date of Patent: Dec. 3, 1996

[54] ELECTROPHOTOGRAPHIC IMAGE FORMING APPARATUS

[75] Inventors: Atsushi Kawai; Hiroshi Sakakibara; Toshifumi Watanabe, all of Aichi-ken; Tetsuya Sakai; Hiroshi Nishikawa, both of Toyokawa, all of Japan

[73] Assignee: Minolta Co. Ltd., Osaka, Japan

[21] Appl. No.: 354,808

[22] Filed: Dec. 13, 1994

[30] Foreign Application Priority Data

Dec. 22, 1993 [JP] Japan ..... 5-324491

[51] Int. Cl.[6] ..... G03G 21/00

[52] U.S. Cl. ..... 355/246; 355/204; 355/208

[58] Field of Search ..... 355/245, 246, 355/208, 203, 204; 118/688–691

[56] References Cited

U.S. PATENT DOCUMENTS 4,468,112 8/1984 Suzuki et al. .
4,980,726 12/1990 Aoki .
5,083,160 1/1992 Suzuki et al. ..... 355/208
5,357,317 10/1994 Fukuchi et al. ..... 355/208
5,436,705 7/1995 Raj ..... 355/246

FOREIGN PATENT DOCUMENTS 3-61947 9/1991 Japan .
2-230272 9/1992 Japan .

*Primary Examiner*—Matthew S. Smith
*Attorney, Agent, or Firm*—Burns, Doane, Swecker & Mathis, LLP

[57] ABSTRACT

A copying machine wherein a developing device is provided with a first sensor for detecting the toner density in a developer and a second sensor which is provided around a photosensitive drum for detecting the amount of deposited toner on a test pattern. The toner supply is controlled according to a result detected by the second sensor. When the toner density is judged high from a result detected by the first sensor, a developing bias voltage is set high by a computer, and when the toner density is judged low, the developing bias voltage is set low.

18 Claims, 20 Drawing Sheets

ELECTROPHOTOGRAPHIC IMAGE FORMING APPARATUS

BACKGROUND OF THE INVENTION

1. Field of the Invention

The present invention relates to an image forming apparatus, and more particularly to a control for stabilizing an image density of an electrophotographic image forming apparatus wherein a toner image is formed on a photosensitive member and the toner image is transferred onto a sheet.

2. Description of Related Art

Generally, in an electrophotographic copying apparatus which forms an image by using a mixed developer of toner and carrier, in order to stabilize the image density, an amount of toner which corresponds to the consumed amount is supplied successively to a developing device. This kind of toner supplying control is classified roughly into AIDC (Auto Image Density Control) and ATDC (Auto Toner Density Control). In the AIDC method, a test toner image (a test pattern) is formed in a specified image forming condition on a photosensitive drum and the amount of toner which is deposited on the test pattern is optically detected, and then the detected result is compared with a standard image density. When the detected result is lower than the standard image density, the supplement of the toner is carried out. In the ATDC method, the toner density of a developer contained in a developing device is detected magnetically or an alternative method, and then the detected result is compared with a standard toner density. When the detected result is lower than the standard toner density, the supplement of the toner is carried out.

The developing characteristic is changed according to an environmental condition such as temperature and humidity and an aged deterioration of the apparatus. Also, the detecting characteristic of sensors is changed according to the aged deterioration or stain. The toner density of the developer has a specified tolerance. When the toner density exceeds the tolerance, spotting of the toner on the background and scattering of toner outside the developing device occur. On the other hand, when the toner density becomes lower than the tolerance, the carrier sticks to the photosensitive drum.

In the AIDC, since the toner supplement is controlled concerning only the amount of toner which sticks to the photosensitive drum, when the environment condition is changed, the toner density of the developer may change largely and may be out of the tolerance. In the ATDC, the toner supplement can be controlled such that the toner density is kept within the tolerance. However, the image density on the photosensitive drum may be unstable when the environmental condition is changed.

SUMMARY OF THE INVENTION

An object of the present invention is to provide an image forming apparatus which, by using the AIDC method and the ATDC method together, stabilizes the image density, prevents spotting or scattering of toner and prevents sticking of carrier to the photosensitive member.

Another object of the present invention is to provide an image forming apparatus which has a stabilized image density and a fine tone reproduction.

In order to attain the objects, an image forming apparatus according to the present invention comprises first detecting means (an AIDC sensor) for detecting an amount of deposited toner on a test toner image which is formed on an image carrier, toner supply control means for controlling a toner supply according to a detecting result of the first detecting means, second detecting means (ATDC sensor) for detecting a toner density in a developer which is contained in developing means and image forming condition changing means for changing an image forming condition according to the detected result of the second detecting means. The image forming condition is conditions at each process of forming an image, such as a developing bias voltage, a charged voltage of the image carrier and an amount of exposure. A developing efficiency is changed by these conditions.

In the present invention, basically, the toner supply is controlled according to the detected amount of deposited toner on the test toner image which is detected by the AIDC sensor. The toner is supplied when the detected amount of toner is lower than a first standard density (an objective value of the image density on the image carrier). The density of the image is stabilized by such toner supply control. However, the toner density in the developer is changed by the environmental change. When the developing efficiency is lowered by the environmental change, the toner density tends to be increased by the AIDC in order to maintain a specified image density. In the opposite case, the toner density tends to be decreased. The ATDC sensor detects such toner density in the developer, and the image forming condition is changed according to the detecting result.

The image forming condition changing means compares the detected result of the ATDC sensor and a second standard density (the objective value of the toner density in the developer which has a specified tolerance). When the detected result is higher than the second standard density, the image forming condition is changed to increase the developing efficiency. Thereby, the image density becomes slightly high temporarily. However, consumption of toner is promoted, and the toner density can be kept within the tolerance. Thus, spotting and scattering of the toner can be prevented. When the detected result is lower than the second standard density, the image forming condition is changed to decrease the developing efficiency. Thereby, the image density becomes slightly low temporarily. However, consumption of toner is restrained, and the toner density can be kept within the tolerance. Thus, the carrier is prevented from sticking to the image carrier.

Also, in the image forming apparatus according to the present invention, the image forming condition changing means preferably changes the $\gamma$ correction as well as the image forming condition. The $\gamma$ correction is a correction made to the relative relationship between the image density and the exposed amount of the image carrier. The tone reproduction is stabilized by changing the $\gamma$ correction.

BRIEF DESCRIPTION OF THE DRAWING

These and other objects and features of the present invention will become apparent from the following description with reference to the accompanying drawings, in which.

DETAILED DESCRIPTION OF THE PREFERRED EMBODIMENTS

The description of preferred embodiments according to the present invention is given below, referring to the accompanying drawings.

Figure 1:
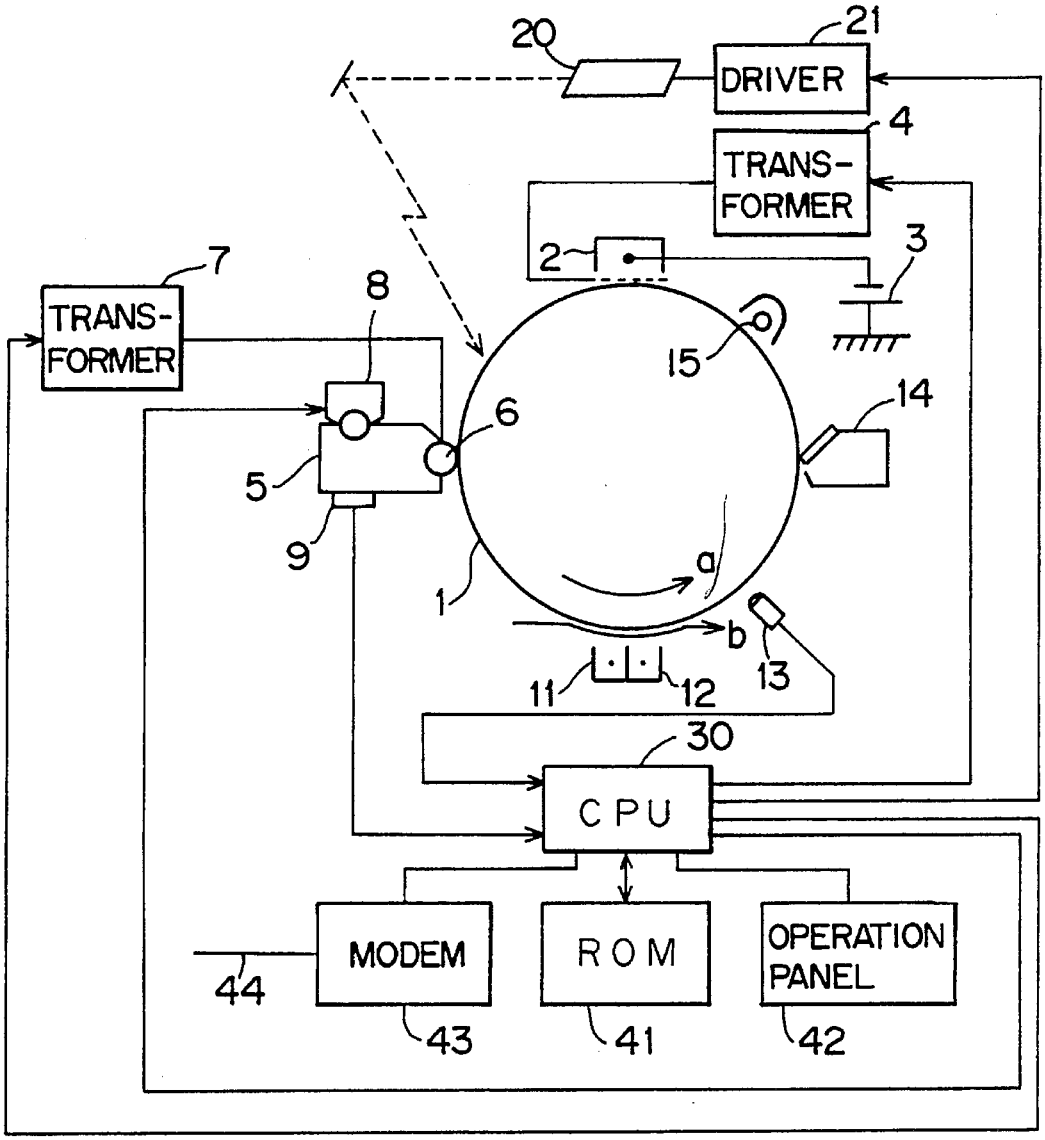
FIG. 1 is a basic elevational view of a copying machine which is an embodiment of the present invention.

FIG. 1 shows a main part of a digital copying machine which is an embodiment of the present invention. This copying machine is mainly composed of a photosensitive drum 1 which rotates in a direction indicated with an arrow a and various image forming devices which are provided around the photosensitive drum 1. More specifically, a charger 2, a developing device 5, a transfer charger 11, a sheet separating charger 12, an AIDC sensor 13, a toner cleaner 14 with a blade and an eraser lamp 15 for removing electricity are provide around the photosensitive drum 1.

A scorotron charger which has a grid is used as the charger 2, and a constant voltage is applied to a charge wire thereof from an electric source 3. A grid voltage is applied from a transformer 4 to the grid, and the charged voltage of the photosensitive drum 1 is controlled by changing the grid voltage. In other words, the charged voltage of the photosensitive drum 1 is equal to the grid voltage.

An exposure is carried out by emitting a modulated light from a laser diode 20. This copying machine has an image reader (not shown), and a driver 21 drives the laser diode 20 according to image data which are read by the image reader to form an electrostatic latent image on the photosensitive drum 1.

The developing device 5 uses a well-known magnetic brush developing method wherein a latent image is developed by supplying a mixed developer of carrier and toner at a peripheral surface of a developing sleeve 6. In the developing device 5, the toner is supplied by a hopper 8. An ATDC sensor 9 is provided at the developing device 5 and detects the toner density in the developer by measuring the magnetic induction of the developer. Also, a developing bias voltage is applied to the developing sleeve 6 from a transformer 7.

In the copying machine, the polarity of the photosensitive drum 1 which is charged by the charger 2 and the charged polarity of the toner are the same (for example, negative polarity). Also, the electrostatic latent image which is formed by the modulated light emission from the laser diode 20 is negative, and the electric potential of the image portion is almost 0 V. For development, a developing bias voltage which has the same polarity as the charged polarity of the toner is applied to the developing sleeve 6, and thereby, the toner is deposited onto the image portion which has an electric potential of almost 0 V (reversal). When the transformer 7 is controlled to set the developing bias voltage high, the developing efficiency becomes high. On the other hand, when the developing bias voltage is set low, the developing efficiency becomes low.

Meanwhile, copy sheets are fed one by one from a sheet feeding cassette (not shown) and sent in a direction indicated with an arrow b. Then, with an electric discharge which has the opposite polarity to the charged polarity of the toner from a transfer charger 11, a toner image is transferred onto the copy sheet from the photosensitive drum 1.

Since the above image forming process of the copying machine is well-known, the detailed explanation thereof is omitted.

Figure 2:
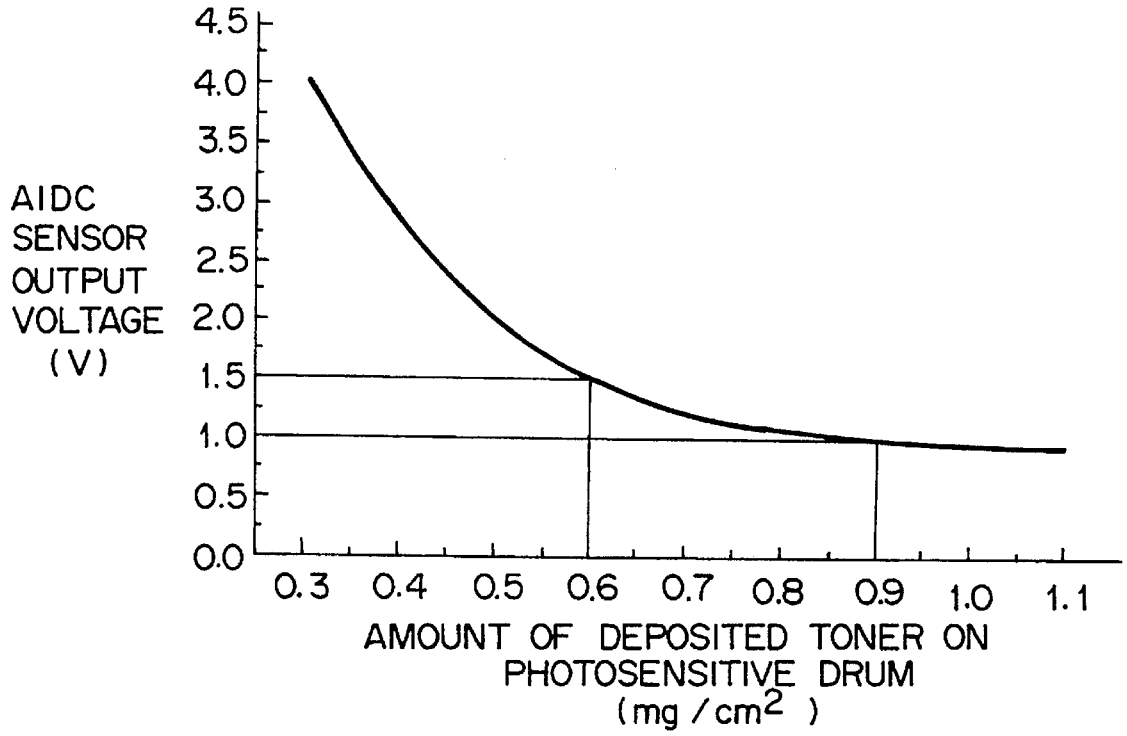
FIG. 2 is a graph which shows a relationship between the amount of deposited toner on a photosensitive drum and the detected output of an AIDC sensor.

The AIDC sensor 13 detects the amount of deposited toner per unit area by measuring the amount of light which is reflected from the test toner image formed on the photosensitive drum 1. A latent test toner image of a specified area is formed out of an image forming area of the photosensitive drum 1 for each copy sheet processing. Then the latent test toner image is developed by the developing device 5. In the following, this test toner image is referred to as a test pattern. The relationship between the amount of the toner deposited on the test pattern and the output of the AIDC sensor 13 is shown in FIG. 2. The deposited toner amount (the developed image density) can be estimated from this output voltage value. In this embodiment, a stabilized image density (standard density) can be obtained when the output voltage is between 1.0 V and 1.5 V. When the output voltage becomes more than 1.5 V, the hopper 8 is driven to supply the toner to the developing device 5.

Figure 3:
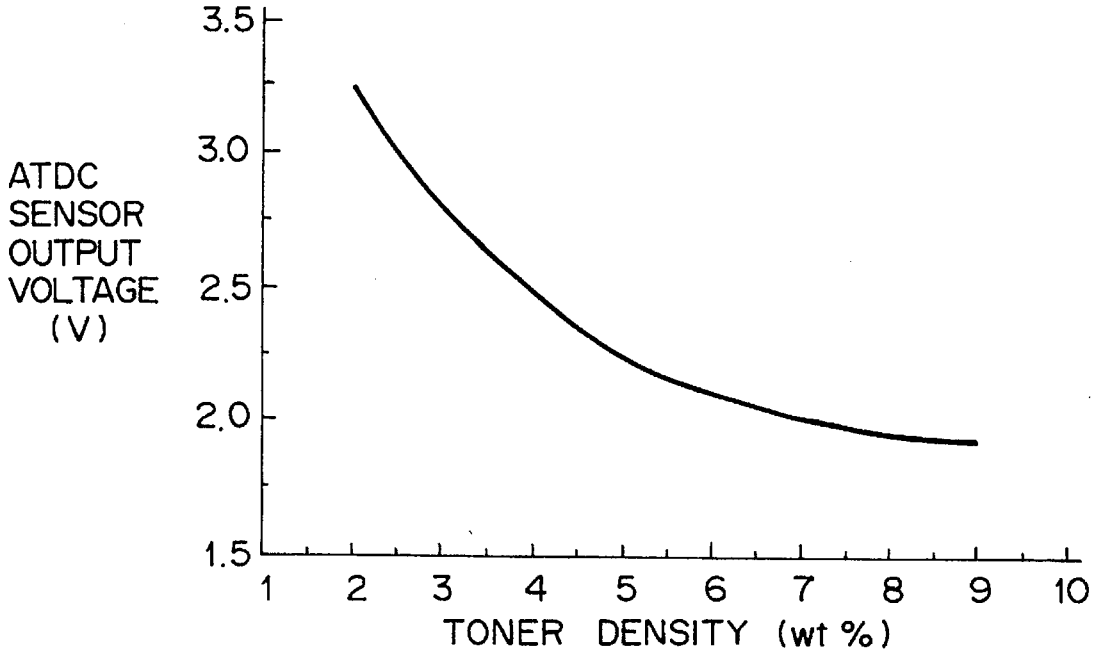
FIG. 3 is a graph which shows a relationship between the toner density in a developer and the detected output of an ATDC sensor.

FIG. 3 shows the relationship between the toner density in the developer and the output voltage of the ATDC sensor 9. The toner density can be estimated from the output voltage value. The toner density in the developer has a specified permissible standard density. When the output voltage indicates that the toner density is out of this standard density, the image forming condition is changed. In this embodiment, the image forming condition to be changed is the developing potential difference (difference between the voltage of imaged portions of the photosensitive drum 1 and the developing bias voltage), and actually the developing potential difference is changed by changing the developing bias voltage. In the present invention which uses a reversal development, when the developing bias voltage is set high, the developing efficiency becomes high, and when the developing bias voltage is set low, the developing efficiency becomes low. As shown in Table 1, the developing potential difference of step number 0 which is the standard is changeable in both plus and minus directions step by step between PMAX and NMAX. The larger the step number is in the plus direction, the larger the developing potential difference is set.

TABLE 1

| Step Number | Developing Potential Difference | γ Correction Table |
|---|---|---|
| PMAX | Δ V (PMAX) | γ (PMAX) |
| . | . | . |
| . | . | . |
| . | . | . |
| +2 | Δ (+2) | γ (+2) |
| +1 | Δ (+1) | γ (+1) |
| 0 | Δ (0) | γ (0) |
| −1 | Δ (−1) | γ (−1) |
| −2 | Δ (−2) | γ (−2) |
| . | . | . |
| . | . | . |
| . | . | . |
| NMAX | Δ V (NMAX) | γ (NMAX) |

The relationship between the toner density and the developing potential difference is explained below.

In a normal condition, the copying operation is carried out in the step number 0, and as explained above, the toner supply is controlled according to the output voltage of the AIDC sensor 13. In an environment wherein the temperature and humidity are stabilized, the change of the toner density is small. However, a large change in the temperature and/or the humidity causes a change in the charged amount of toner, and accordingly, the amount of toner moved to the photosensitive drum 1 by a unit developing potential difference (the developing efficiency) changes. Thus, the toner density which obtains the objective image density also changes. For example, when the humidity falls, the charged amount of toner increases and the amount of toner sticking to the carrier decreases. Therefore, the developing efficiency is lowered. Since the AIDC supplies the toner in order to obtain the objective image density, the toner density in the developer may be high. When the toner density becomes high in this way, if the developing potential difference is set large, the consumption of toner is promoted with the toner supply being restricted. Consequently, the toner density can be lowered. Conversely, when the toner density is lowered, if the developing potential difference is set small, the toner supply is promoted with the consumption of toner being restricted. Thus, the toner density can be raised.

In the present embodiment, the image density is stabilized by the toner supply control using the AIDC sensor 13. At the same time, the toner density in the developer can be kept in a specified acceptable range by controlling the developing potential difference using the ATDC sensor 9. The acceptable range of the toner density depends on the kinds of toner and carrier and the structure of the developing device 5.

In order to change the developing potential difference, in the reversal development system, changing the developing bias voltage or changing the exposure value of the photosensitive drum to the laser diode 20 is possible. In the normal development system, changing the charged voltage of the photosensitive drum is possible. Also, a combination of these changes is possible.

Figure 5A:
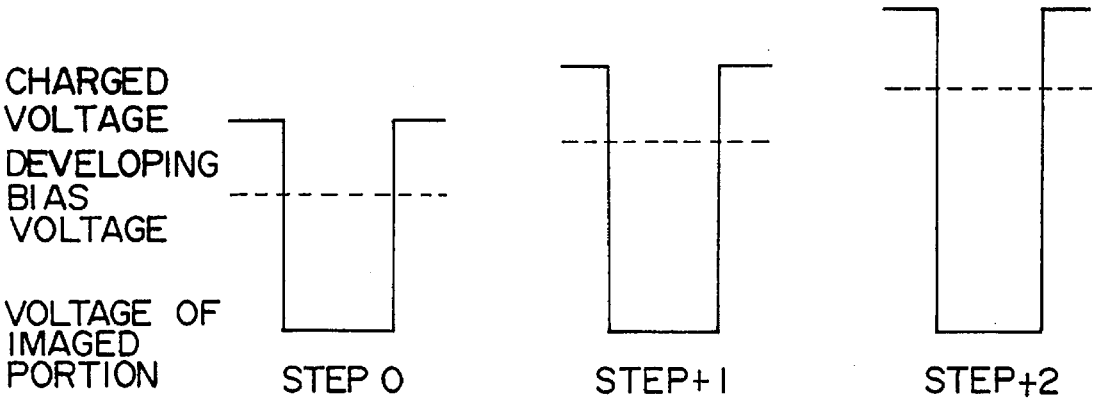
FIGS. 5*a* and 5*b* are charts which explain step changes of the developing potential difference which are carried out step by step.

In the reversal development system, the difference between the developing bias voltage and the charged voltage of the photosensitive drum is usually kept in a specified value. If this voltage difference is too small, toner spotting on the background is apt to occur, and if the voltage difference is too large, the carrier is apt to stick to the photosensitive drum. The present embodiment uses the reversal development system, and the developing potential difference is controlled by changing the developing bias voltage. In this case, as shown in FIG. 5*a*, the grid voltage of the charger 2 is changed such that the voltage difference between the charged voltage of the photosensitive drum and the developing bias voltage is fixed at all the steps (refer to Table 1). With this control, the toner spotting and the carrier sticking can be prevented.

Figure 5B:
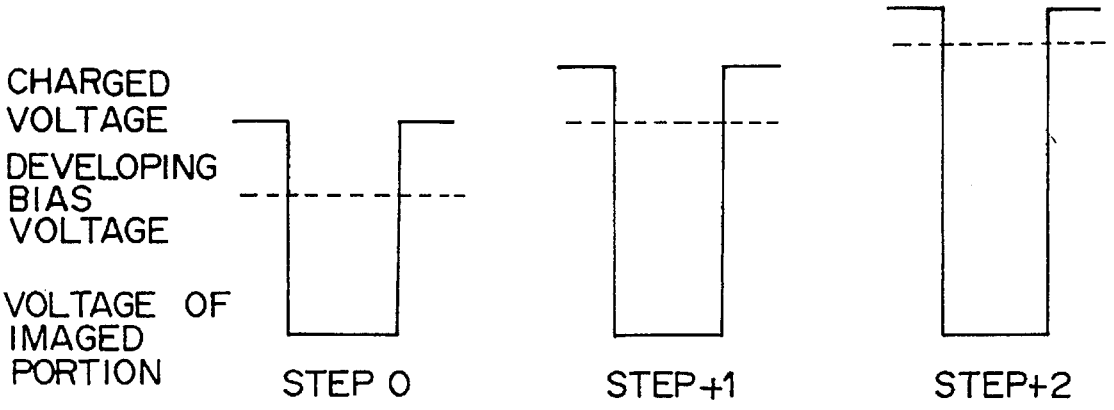

Also, in a developing system wherein carrier tends to stick to the photosensitive drum when the charged voltage becomes high, as shown in FIG. 5*b*, the developing bias voltage can be controlled to decrease the voltage difference between the developing bias voltage and the charged voltage as the charged voltage becomes large.

Next, a tone reproduction (a γ correction) is explained below.

Figure 4:
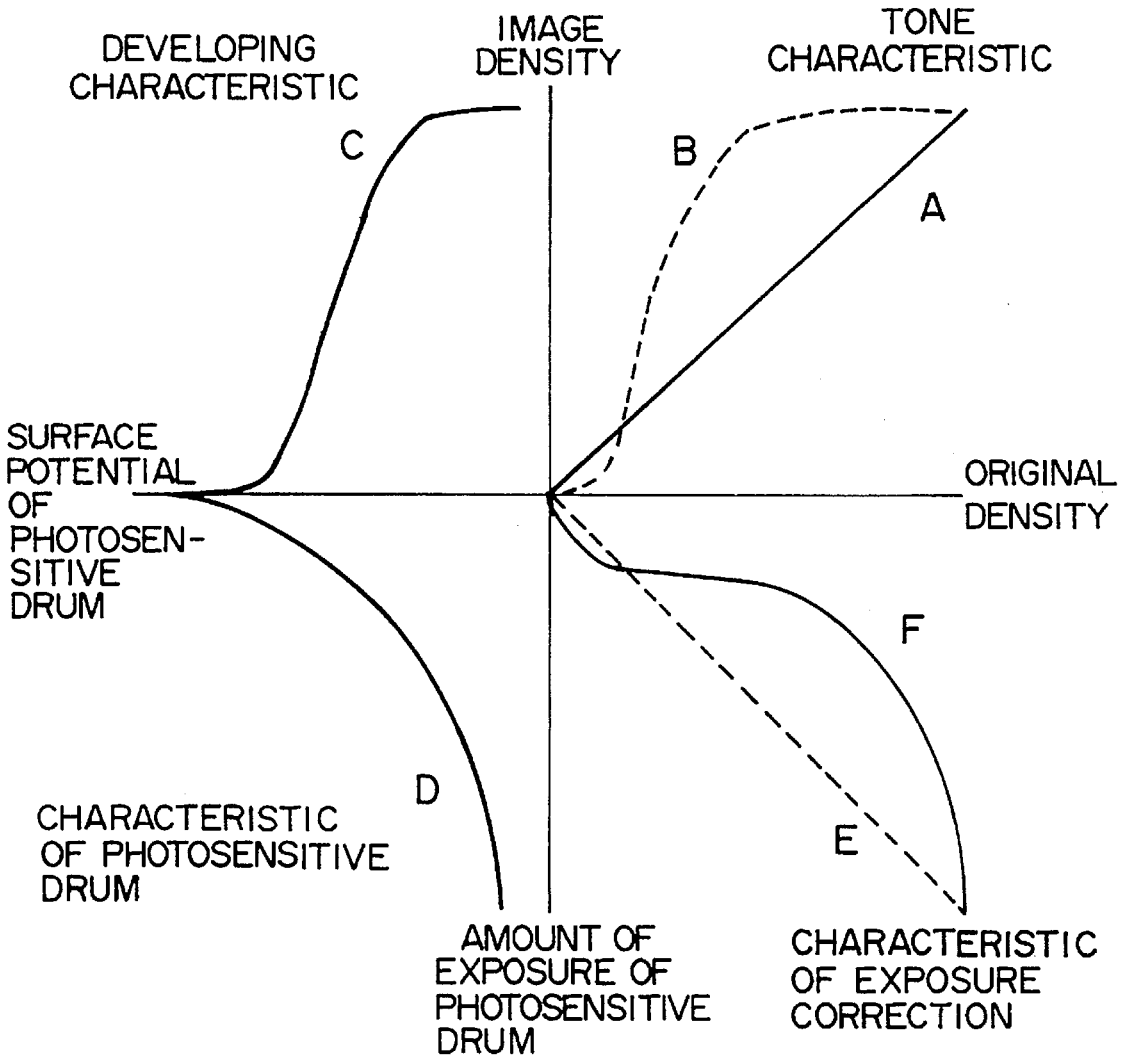
FIG. 4 is a sensitometry chart of an imaging process.

The image density which is read by the image reader is indicated an eight-bit data, and converted to a luminous energy of the laser diode. The conversion data are called a γ correction table. The γ correction table is made according to a sensitometry chart of the image forming process shown in FIG. 4. In FIG. 4, the first quadrant shows a relationship between the reproduced image density and the original image density (a tone characteristic). The second quadrant shows a relationship between the reproduced image density and the surface potential of the photosensitive drum (a developing characteristic). The third quadrant shows a relationship between the surface potential of the photosensitive drum and the amount of exposure of the photosensitive drum (a characteristic of the photosensitive drum). The fourth quadrant shows a relationship between the amount of exposure and the original image density (a characteristic of the exposure correction).

If the exposure correction characteristic is linear as a indicated with a dotted straight line E, that is, if the amount of exposure is proportional to the original image density, since the developing characteristic C and the characteristic D of the photosensitive drum are nonlinear, the tone characteristic becomes nonlinear as indicated with a dotted line B, and the tone reproduction becomes unclear. By setting the exposure correction characteristic nonlinear as indicated with a line F, the tone characteristic becomes linear as indicated with line A. For this reason, the γ correction table shows data of the exposure value which can set the tone characteristic linear.

In the present embodiment, since the developing potential difference is changed according to the toner density which is detected by the ATDC sensor 9, the developing characteristic C is changed. Therefore, the γ correction table needs to be changed in order to maintain the fine tone reproduction. Thus, as shown in Table 1, γ correction tables which correspond to the respective steps of the developing potential difference are made beforehand, and the γ correction table is changed in synchronization with the change of the developing potential difference. Therefore, the fine tone reproduction can be maintained.

Next, the control for stabilizing the image density in the present embodiment is explained.

The control is carried out mainly in a CPU 30 shown in FIG. 1. The output voltages of the sensors 9 and 13 are inputted to the CPU 30, and the CPU 30 outputs control signals to the grid voltage transformer 4, the developing bias voltage transformer 7 and the toner hopper 8 of the developing device 5 and the driver 21 of the laser diode 20. Also, the CPU 30 has a ROM 41. The ROM 41 contains various data of the developing potential difference and the γ correction table of the respective steps shown in Table 1. Further, the CPU 30 exchanges various signals with an operation panel 42 of the copying machine, and is connected with a telephone line 44 via a modem 43.

The control procedure is explained below referring to flowcharts in FIGS. 6 through 17.

Figure 6:
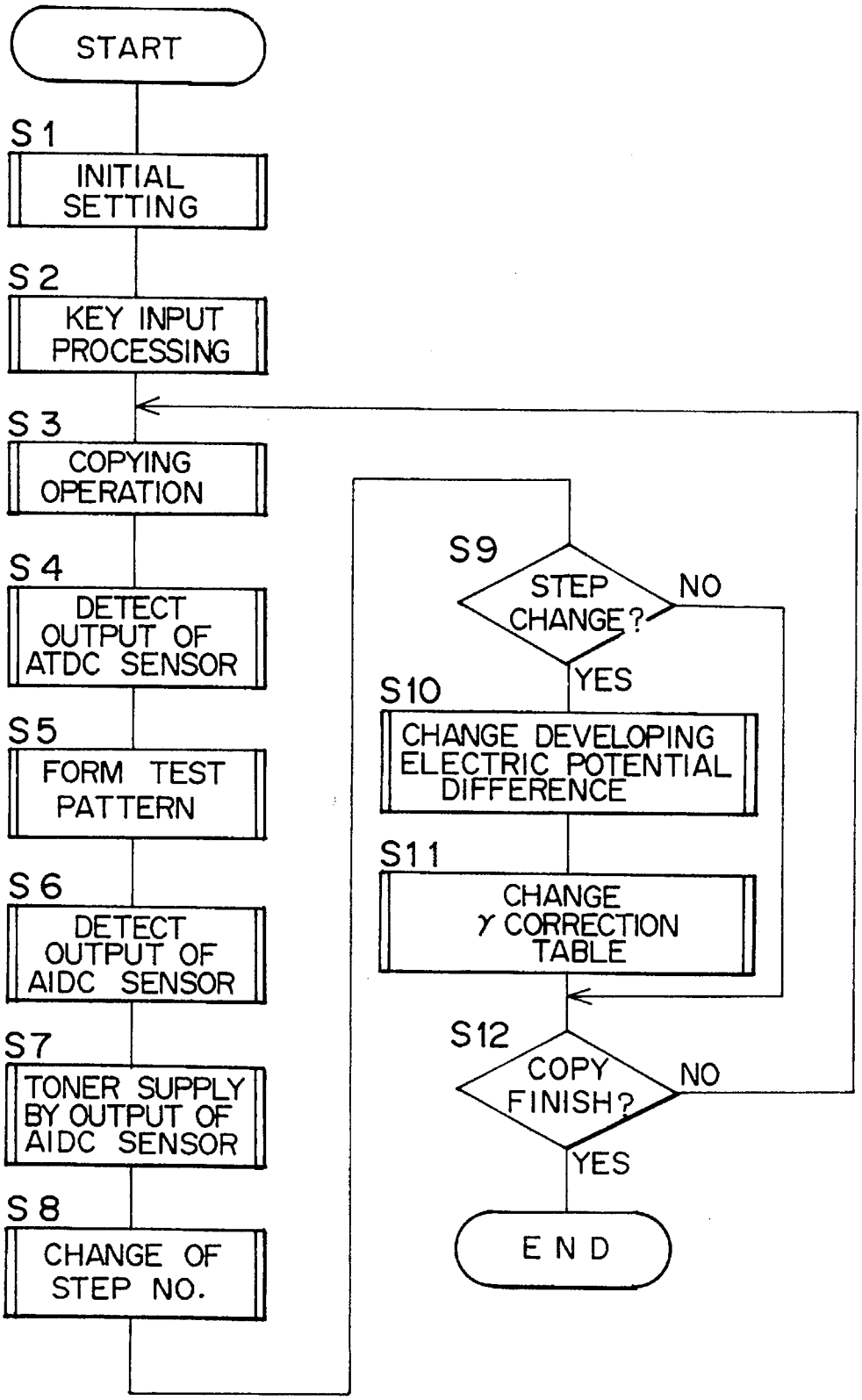
FIG. 6 is a flow chart which shows a main routine of a control procedure carried out by a CPU.

FIG. 6 shows a main routine of the CPU 30.

When the CPU 30 is reset, a program is started. First, an initial setting for setting various registers and devices at initial mode is carried out at step S1. Next, at step S2, a processing for setting a copy mode which is inputted with keys on an operation panel 42 by an operator is carried out, and at step S3, a copying operation according to the input copy mode is conducted.

The routine from step S4 is carried out when copying operation of each sheet is finished. That is, at step S4, the toner density in the developer is detected based on the output voltage of the ATDC sensor 9. At step S5, a test pattern is formed on the photosensitive drum 1, and at step S6, the amount of deposited toner on the test pattern is detected based on the output voltage of the AIDC sensor 13. At step S7, the toner is supplied from the hopper 8 according to the detected result from the AIDC sensor 13. At step S8, the step number shown in Table 1 is changed according to the detected result of the sensors 9 and 13. When it is confirmed at step 9 that the step member is changed, the developing potential difference is changed at step S10, and the γ correction table is changed at step S11. Then, whether the copying is finished or not is judged at step S12. If the copying is finished, the above program is finished. If the copying operation is continued (multi copy mode), the operation goes back to step S3.

Figure 7:
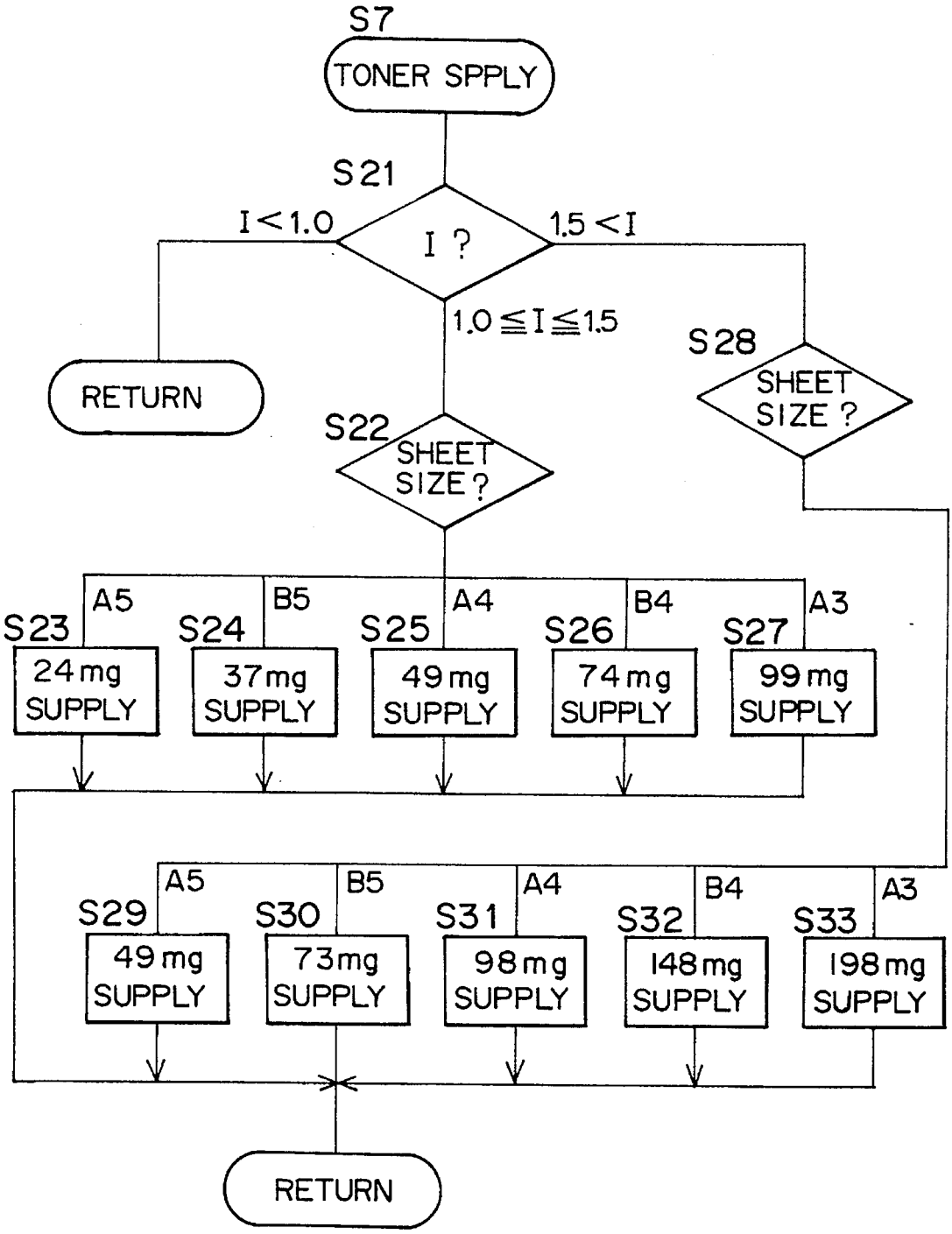
FIG. 7 is a flow chart which shows a subroutine of a toner supply.

FIG. 7 shows a subroutine of toner supply which is carried out at step S7.

In this subroutine, the toner is supplied according to the output voltage I of the AIDC sensor 13 which detects the amount of deposited toner on the test pattern. As shown in FIG. 2, when the output voltage I of the sensor 13 is 1.5 V, the corresponding amount of deposited toner is 0.6 mg/cm$^2$, and when the output voltage I is 1.0 V, the corresponding amount is 0.9 mg/cm$^2$ (objective density). Thus, if the output voltage I is smaller than 1.0 V, the toner is not supplied, and the output voltage I is larger than 1.0 V, the toner is supplied divided into two stages.

More specifically, the output voltage I of the sensor 13 is judged at step S21. If the output voltage I is smaller than 1.0 V, the toner is not supplied and the operation goes back to the main routine. If the output voltage I is between 1.0 and 1.5 V, the sheet size which is used in the previous copying operation is judged at step S22, and a specified amount of toner according to the sheet size is supplied at steps S23 through S27. If the output voltage is larger than 1.5 V, a relatively large amount of toner has been consumed. Thus, the sheet size which is used in the previous copying operation is judged at step S28, and a relatively large amount of toner is supplied according to the sheet size at steps S29 through S33.

Figure 8A:
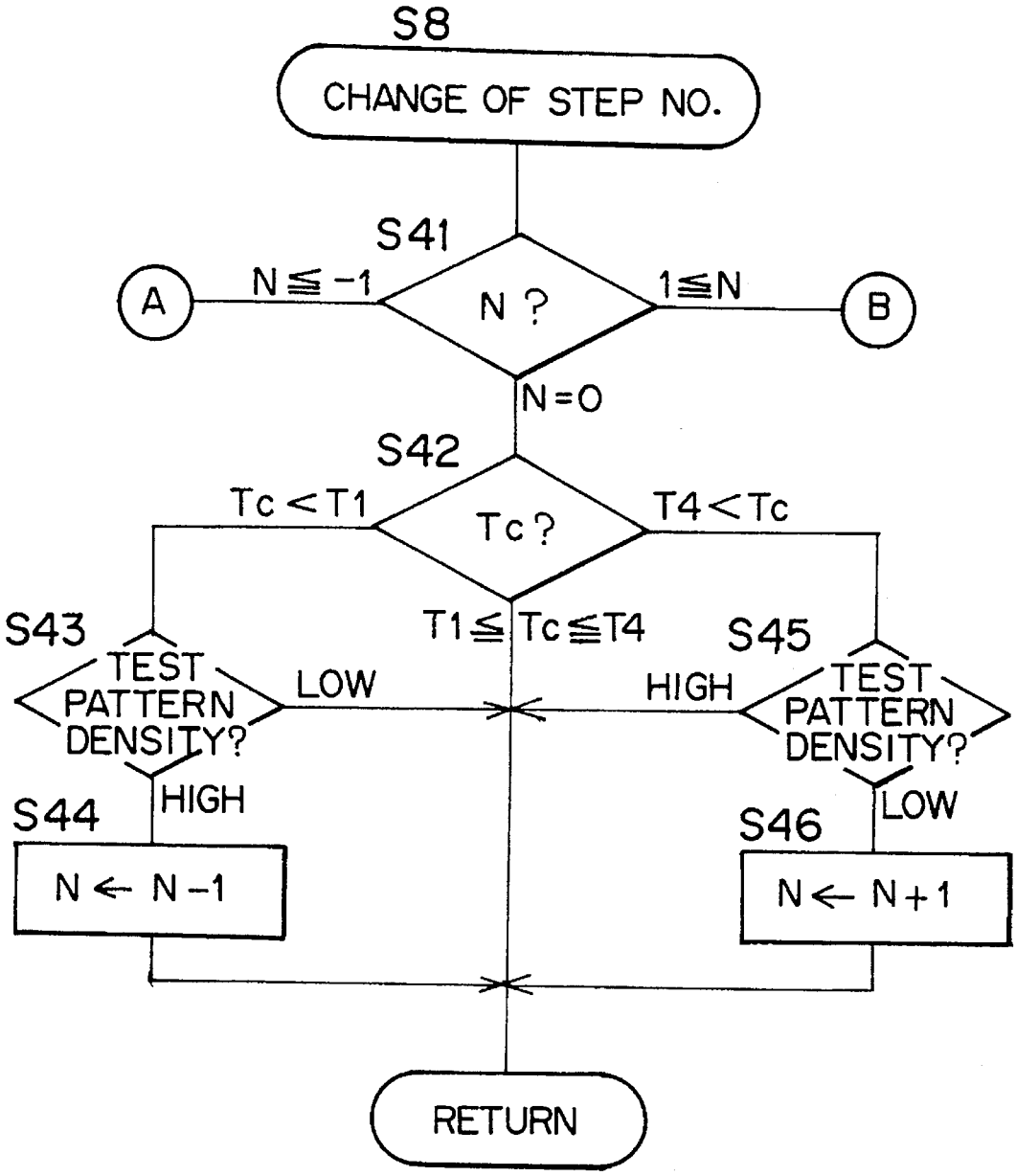
FIGS. 8*a*, 8*b* and 8*c* are flow charts which show subroutine of a change of step number.
Figure 8B:
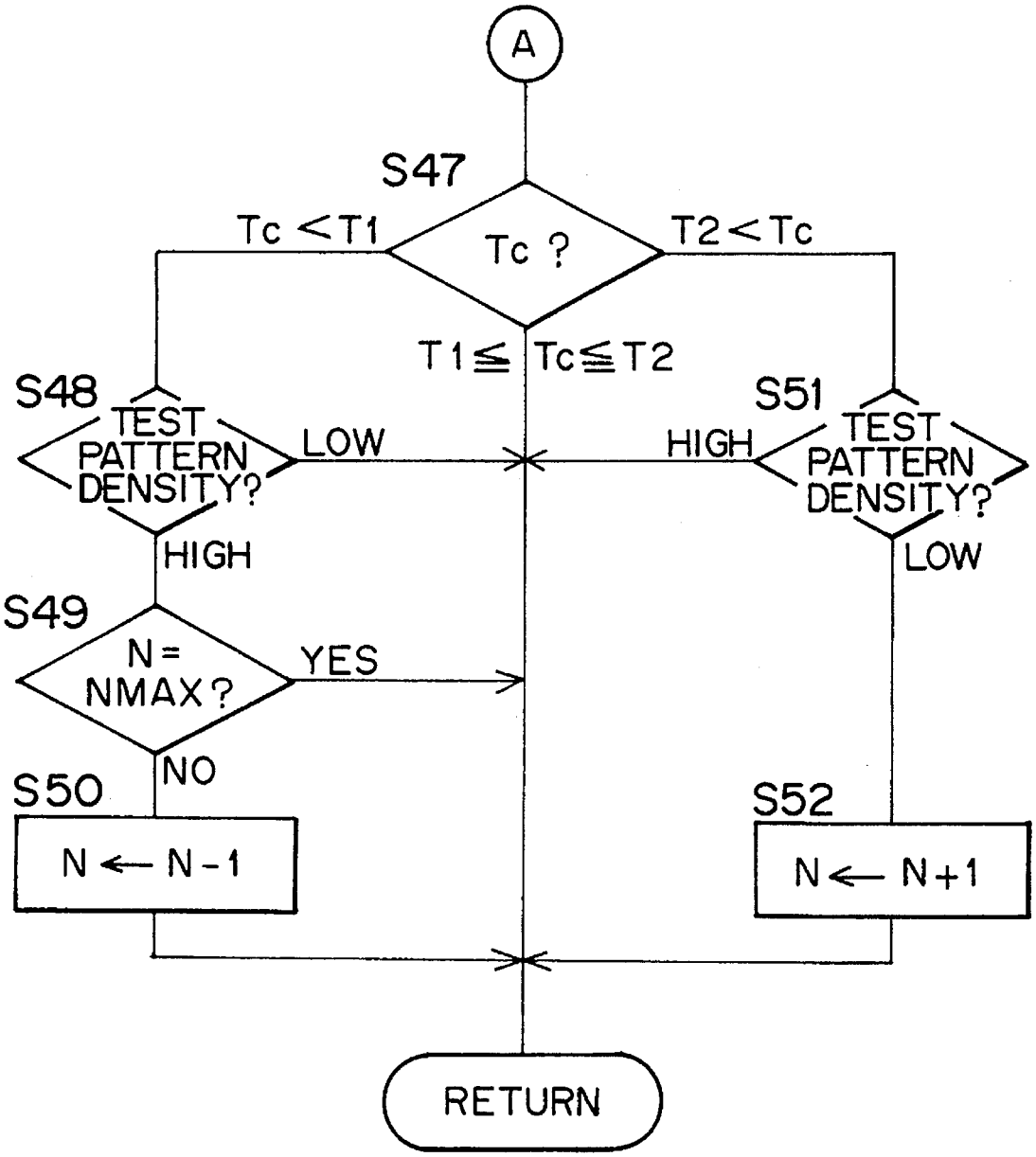
Figure 8C:
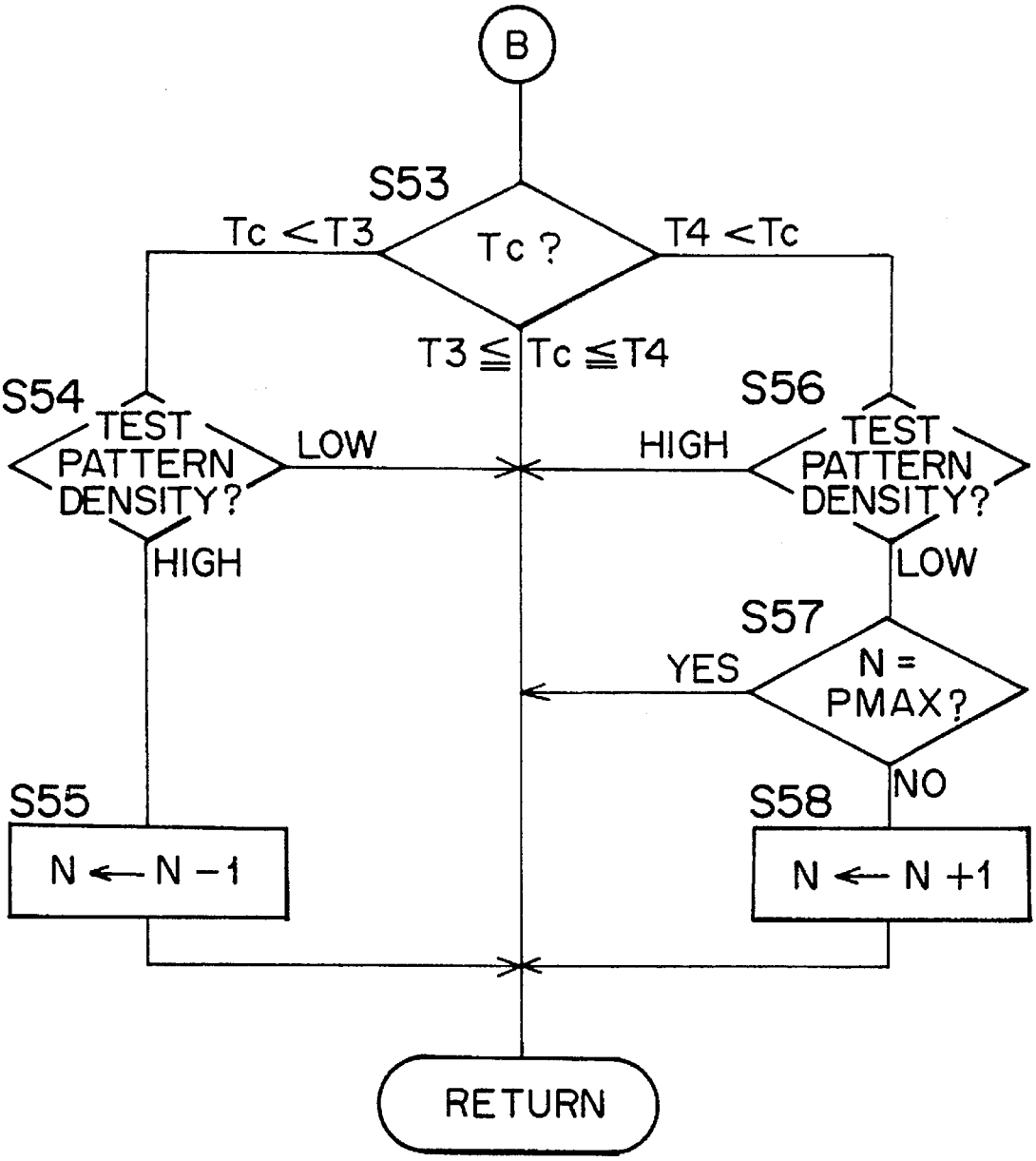

FIGS. 8*a*, 8*b* and 8*c* show a subroutine for changing the step number which is carried out at the step S8.

In this embodiment, the toner density of the developer which is calculated from the output voltage of the ATDC sensor 9 is expressed using points T0, T1, T2, T3, T4 and T5 (T0<T1≦T2<T3≦T4<T5). The relationship between the output voltage and the toner density is shown in FIG. 3. The tolerance of the toner density is a range from T1 to T4.

More specifically, first, the present step number N is judged at step S41. At this step, whether N is 0, less than −1 or more than +1 is judged, and then, according to the value of N, a toner density Tc which is detected by the ATDC sensor 9 is judged at step S42, S47 or S53.

When the step number N is 0, the toner density Tc is judged at step S42. If the toner density is T1≦Tc≦T4, the toner density is in the tolerance, and the operation goes back to the main routine without changing the step number N. If Tc<T1, the density of the test pattern is judged at step S43. At this step, the density of the test pattern means the density which is estimated from the output voltage of the AIDC sensor 13. When the output voltage is 1.0 V or less, the density is called high, and when the output voltage is 1.5 V or more, the density is called low (this is the same in steps S45, S48, S51 etc.). When the density of the test pattern is high, the step number N is reduced by one at step S44. Thereby, though the image density is lowered temporarily, the consumption of the toner is restrained and the toner density in the developer becomes high. On the other hand, if the density of the test pattern is low, the operation goes back to the main routine without changing the step number N. In this case, the toner is supplied according to the output voltage I of the AIDC sensor 13.

When T4<Tc, the density of the test pattern is judged at step S45. If the density is low, the step number N is increased by one at step S46. Thereby, though the image density temporarily becomes high, the consumption of toner is promoted, and the toner density in the developer is lowered. On the other hand, if the density of the test pattern is high, the operation goes back to the main routine without changing the step number N. In this case, the toner supply according to the output voltage I of the AIDC sensor 13 is not carried out, and the toner density is decreased.

When the present step number is −1 or less, the toner density Tc is judged at step S47. If T1≦Tc≦T2, the operation goes back to the main routine without changing the step number N. If Tc<T1, the density of the test pattern is judged at step S48. If the density is low, the operation goes back to the main routine without changing the step number N. If the density of the test pattern is high, whether the step number N is the lowest value NMAX or not is judged. Unless the step number N is the NMAX, the step number N is decreased by one at step S50, and if the step number has reached the NMAX, the changing of the step number N is not carried out. If T2<Tc, the density of the test pattern is judged at step S51. If the density is high, the operation goes back to the main routine without changing the step number N. If the density of the test pattern is low, the step number N is increased by one at step S52.

When the present step number is 1 or more, the toner density Tc is judged at step S53. If T3≦Tc≦T4, the operation goes back to the main routine without switching the step number N. When Tc<T3, the density of the test pattern is judged at step S54. If the density of the test pattern is low, the operation goes back to the main routine without changing the step number N. If the density of the test pattern is high, the step number N is decreased by one at step S55. If T4<Tc, the density of the test pattern is judged at step S56. If the density of the test pattern is high, the operation goes back to the main routine without changing the step number N. If the density of the test pattern is low, whether the step number N is the highest value PMAX or not is judged at step S57. Unless the step number N is the PMAX, the step number N is increased by one at step S58, and if it has reached the PMAX, the changing of the step number N is not carried out.

In this embodiment, the image density is stabilized by changing the step number N in the above-described way for copying operation to each sheet to control the toner density according to the detected result of the sensors 9 and 13.

This control may be carried out at intervals of a specified number of sheets. Also, it is possible to omit the check of the test pattern density at steps S43, S45, S48, S51, S54 and S56, that is, to change the step number N according to only the detected result of the toner density Tc.

Also in order to prevent the over-control, it is possible that once the step number N is changed, next switching a further change of the step number N is inhibited until a specified number of sheets are copied. The number of copied sheets after the step change is counted by a counter contained in the CPU 30, and until the counted number reaches a specified number (for example, thirty sheets), the step number change is reserved.

Figure 9A:
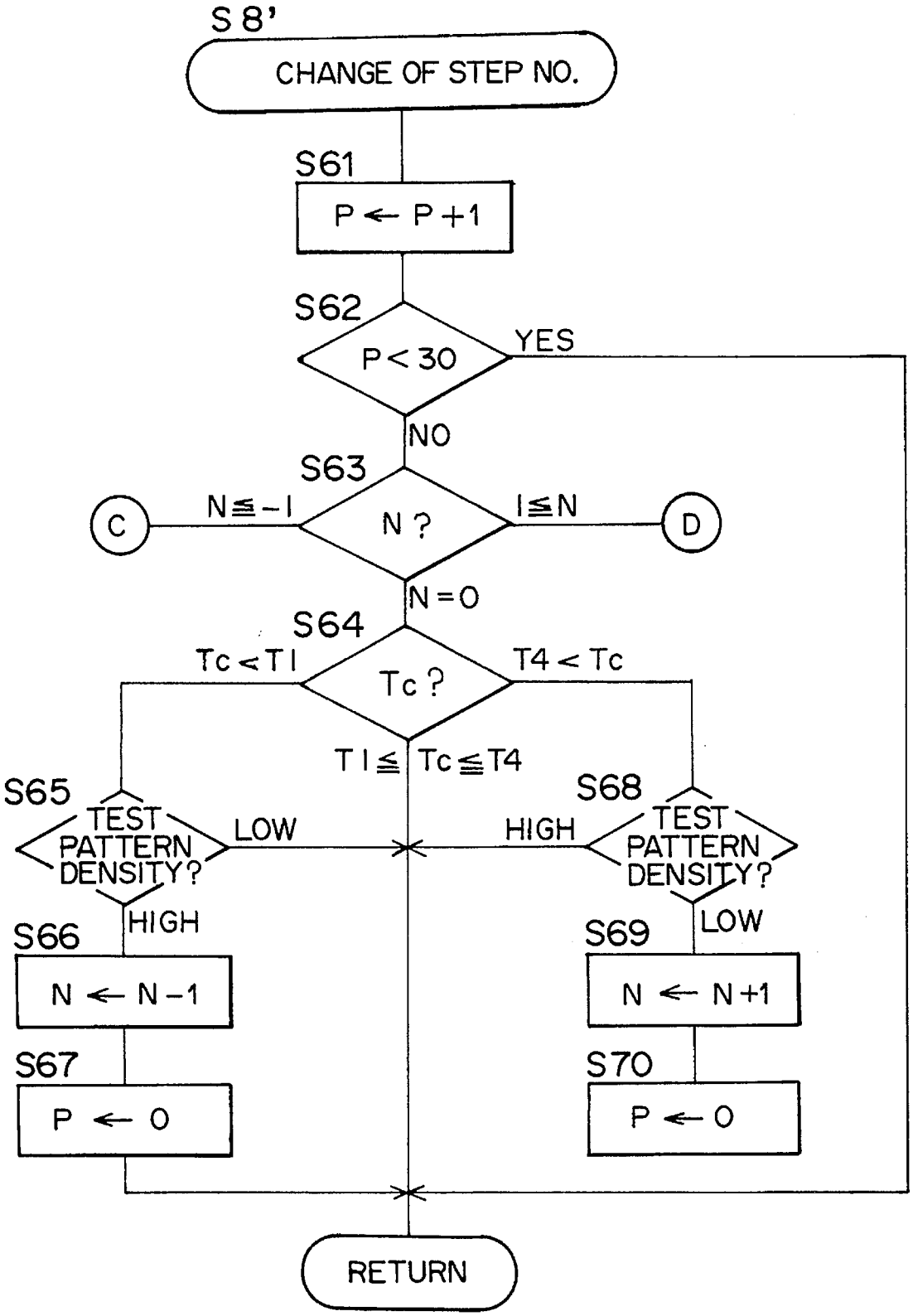
FIGS. 9*a*, 9*b* and 9*c* are flow charts which show other subroutine of a change of step number.
Figure 9B:
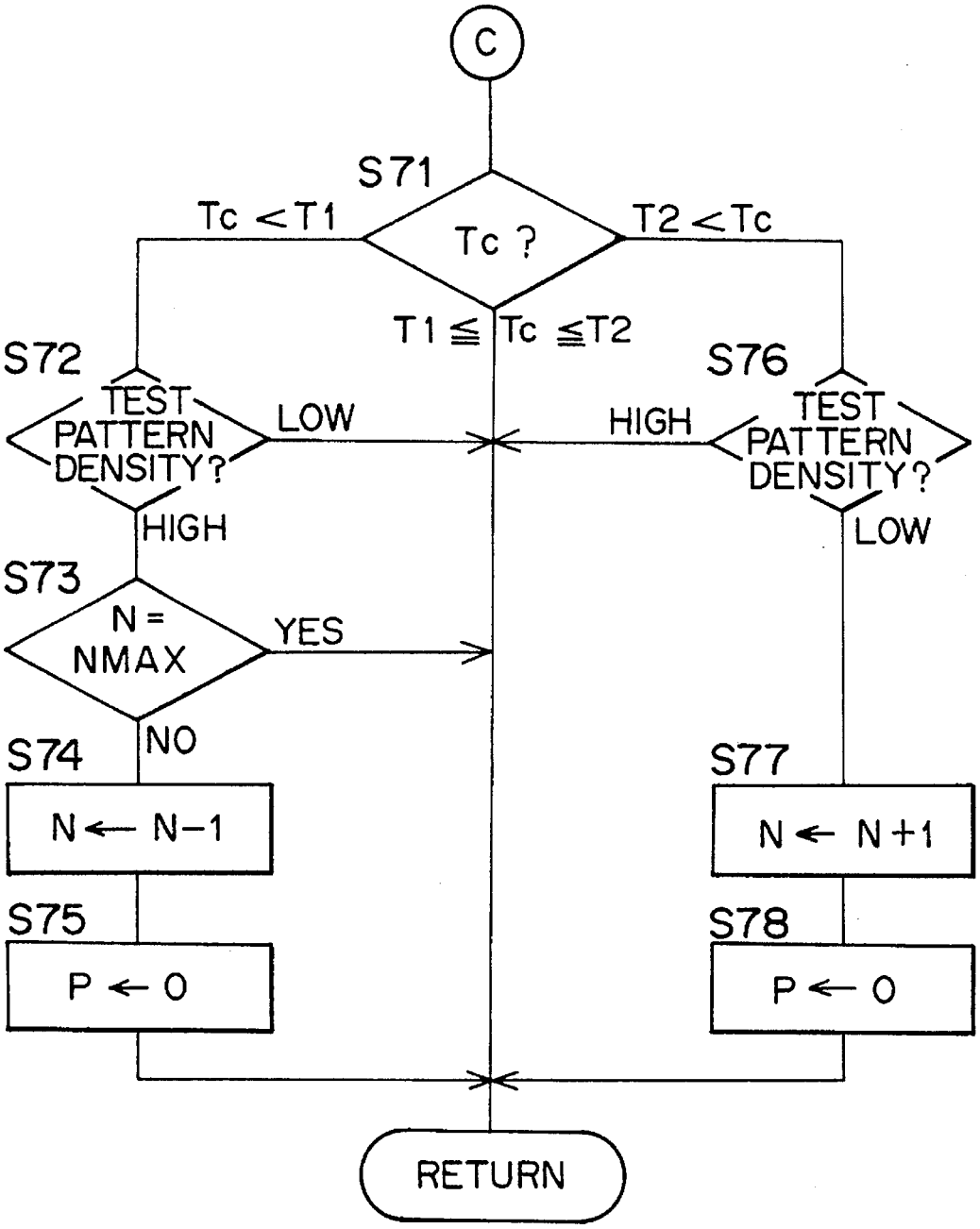
Figure 9C:
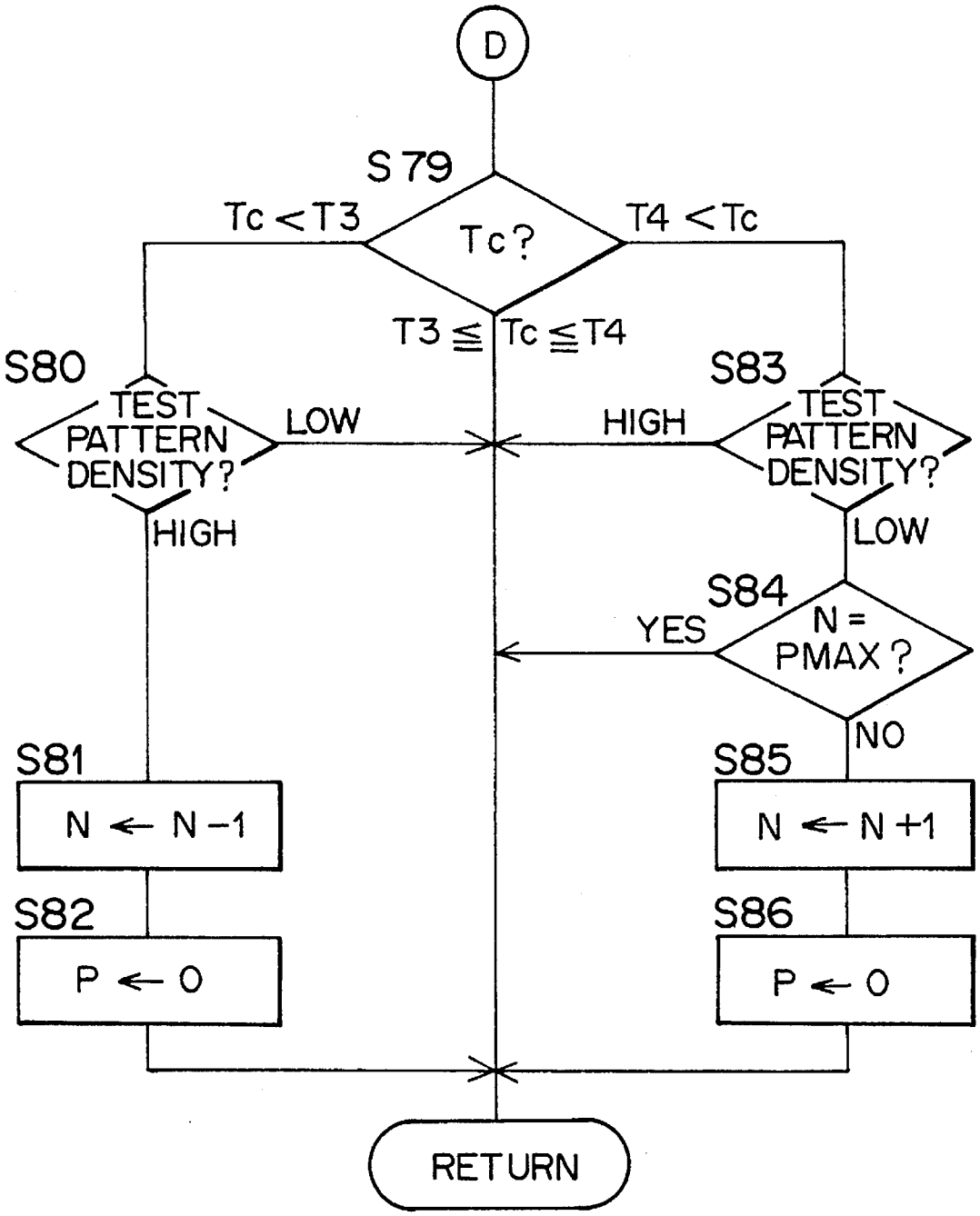

More specifically, the subroutine which is carried out at step S8 of the main routine is exchanged for a subroutine S8' shown in FIGS. 9*a*, 9*b* and 9*c*.

In this subroutine, first, a count value P of the counter is increased by one at step S61, and whether the count value P is smaller than 30 or not is judged at step S62. Until the count value P reaches 30, this subroutine is finished immediately. When the count value P reaches 30, the present step number N is judged at step S63. Steps S63 through S66, S68, S69, S71 through S74, S76, S77, S79 through S81 and S83 through S85 are the same as steps S41 through S58 shown in FIGS. 8*a*, 8*b* and 8*c*, and the step change is judged according to the detected result of toner density of the ATDC sensor 9 and the detected result of the AIDC sensor 13 of the deposited amount of toner on the test pattern. Then after the step number N is switched at steps S66, S69, S74, S77, S81 and S85, the counter is reset to 0 at steps S67, S70 S75, S78, S82 and S86 respectively.

Also, in this step number changing, the number of copy sheets P which reserves the step number change can be changed. The changed amount of toner density as well as the toner density is detected by the ATDC sensor 9. The changed amount Δ is calculated as the difference between the present toner density and the toner density which was detected last time. When the changed amount ΔTc of the toner density is large, the number of sheets P is set small. For example, a reference value P at step S62 is set P=K/ΔTc (K: constant). Thereby, with this control, the image density can be stabilized even in a sudden change of the toner density in the developer.

Also, the toner densities T1 through T4 which are references for the step number change can be changed. The toner charged amount of the developer may be lowered because of the deterioration of the carrier as the copying operation is carried out many times. In this case, the tolerance of the toner density is changed accordingly. Thus, the degree of carrier deterioration is judged from the value of the copy sheet counter which is provided in the copying machine, and the reference values T1 through T4 are changed. More specifically, the reference values T1 through T4 are all lowered as the number of copy sheets is increasing.

Figure 10:
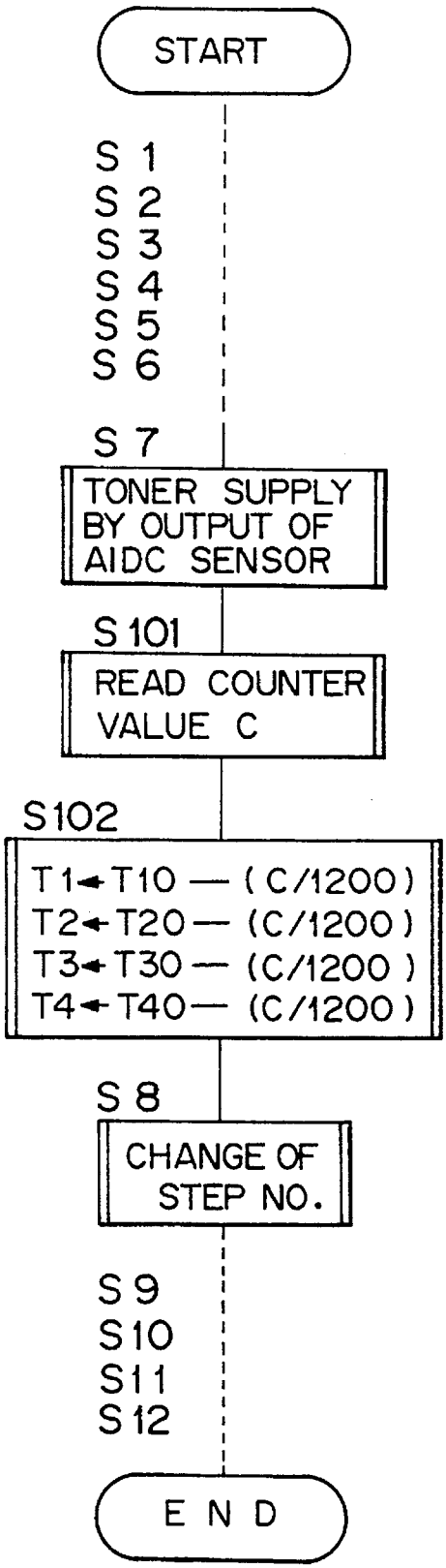
FIG. 10 is a flow chart which shows another example of the main routine of the control procedure carried out by the CPU.

FIG. 10 shows such a procedure. FIG. 10 is a substitute for the main routine shown in FIG. 6. FIGS. 11 through 15 and FIG. 17 are also substitutes for the main routine. In the routine of FIG. 10, steps S101 and S102 are added, and initial values of the toner density T1, T2, T3 and T4 are T10, T20, T30 and T40 respectively. After the toner supply control at step S7, the value C of the copy sheet counter is read at step S101, and the toner densities T1 through T4 are reset at step S102. In this example, it is assumed that the developer is changed to a new one when the number of copy sheets reaches 1200. The count value C indicates the number of copies after the change of the developer, and the toner densities T1 through T4 are shifted by 1% at most.

Further, a limit of the toner density can be set. Basically, the toner density in the developer stays within the tolerance by the above control. However, if it does not, for some reason, for example, the toner density Tc is lower than T0 or higher than T5, it is judged that the toner density can not be controlled.

Figure 11:
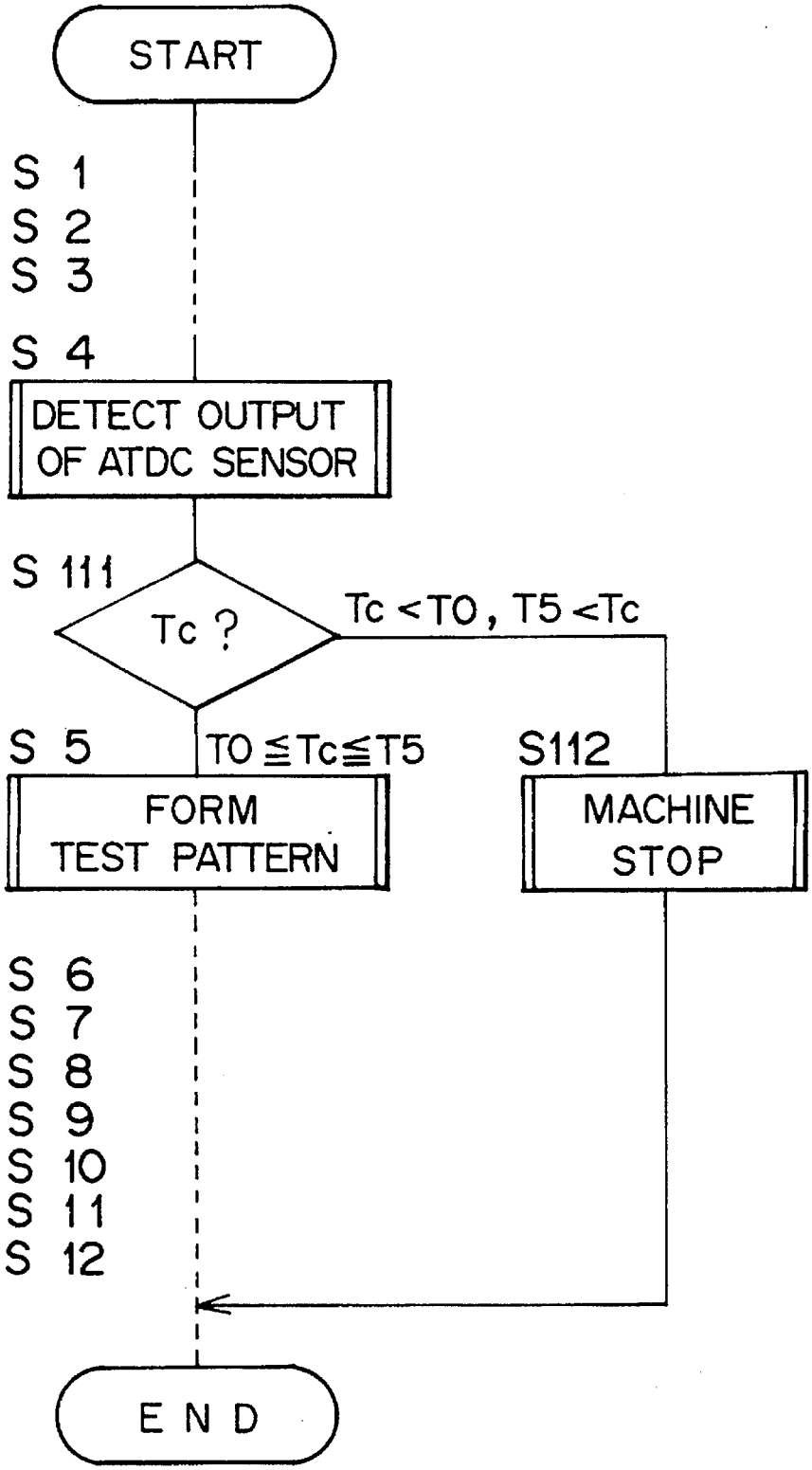
FIG. 11 is a flow chart which shows another example of the main routine of the control procedure carried out by the CPU.
Figure 12:
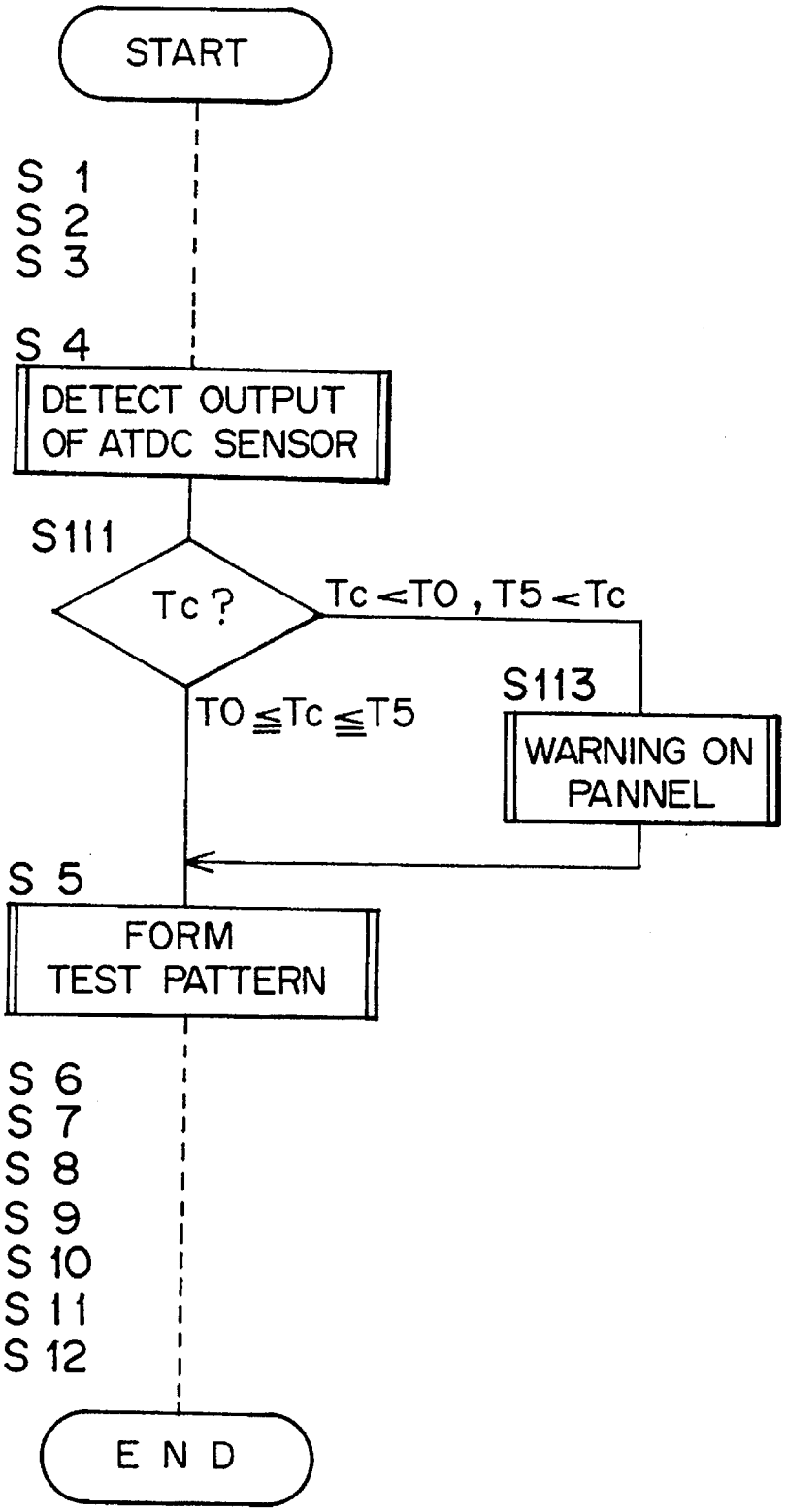
FIG. 12 is a flow chart which shows another example of the main routine of the control procedure carried out by the CPU.
Figure 13:
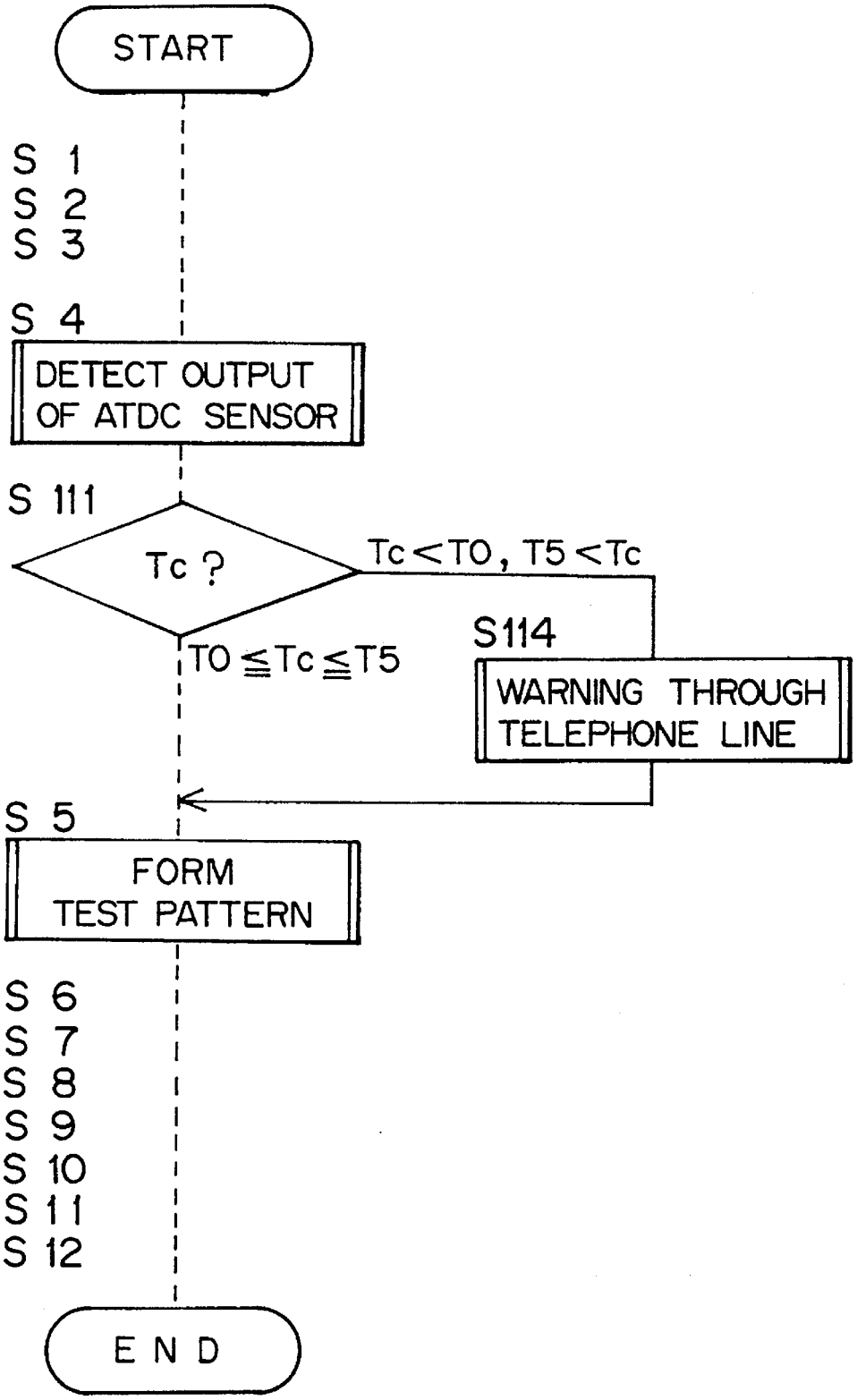
FIG. 13 is a flow chart which shows another example of the main routine of the control procedure carried out by the CPU.
Figure 14:
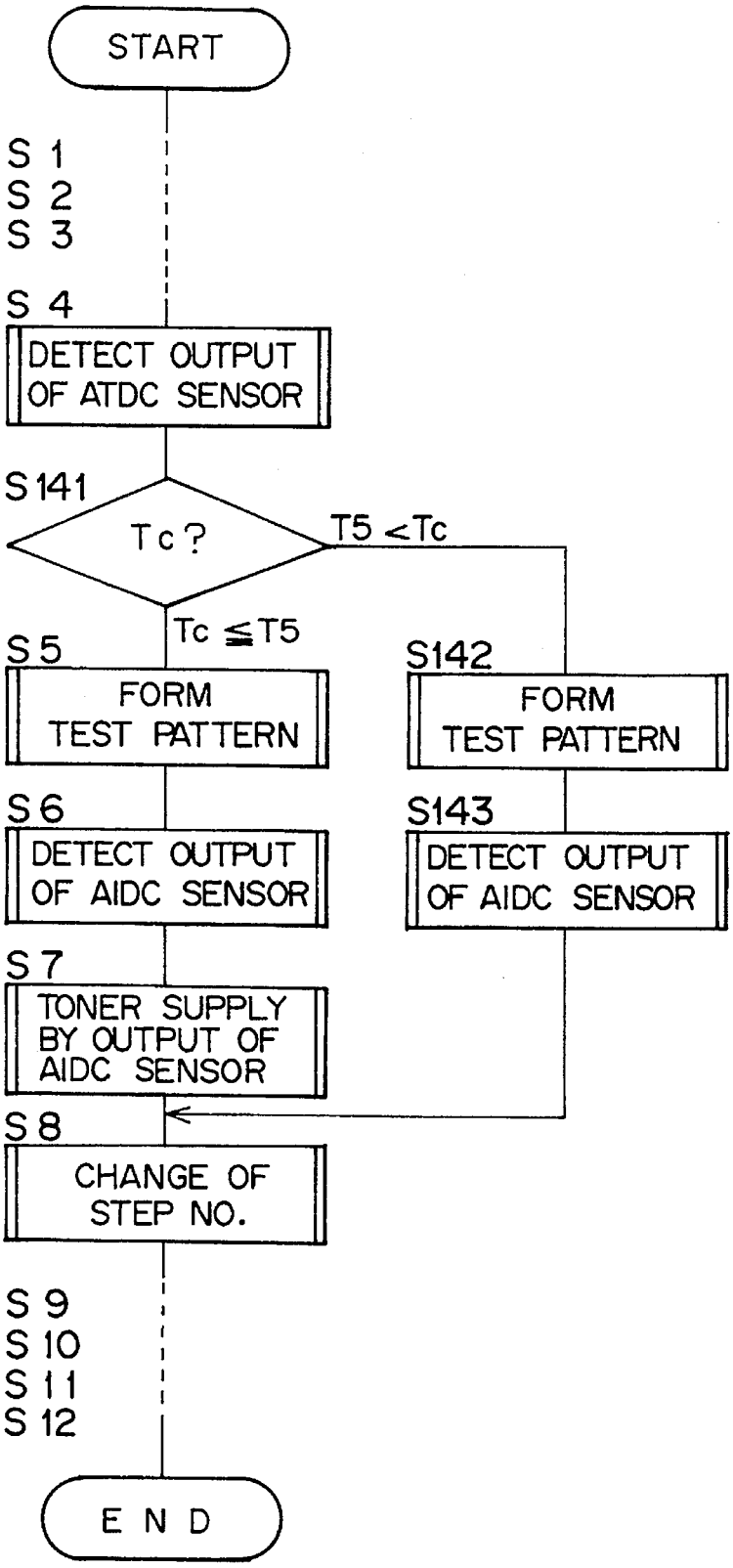
FIG. 14 is a flow chart which shows another example of the main routine of the control procedure carried out by the CPU.

More specifically, as shown in FIG. 11, after detecting the toner density Tc by the ATDC sensor 9 at step S4, if it is judged that the toner density Tc is lower than T0 or higher than T5 at step S111, the machine is stopped at step S112. As a modification, as shown in FIG. 12, a warning is indicated on the operation panel 42 to tell the operator or the service person that the machine is out of order. As another modification, as shown in FIG. 13, a warning can be sent out to a service center via the telephone line 44 at step S114. As another modification, as shown in FIG. 14, if it is judged that the toner density Tc is higher than T5 at step S141, through formation of a test pattern and detection of the output of the AIDC sensor 13 are carried out at steps S142 and S143, the toner supply control by the output of the AIDC sensor 13 at step S7 is not carried out.

Furthermore, as the photosensitive drum 1 is deteriorated, the upper limit of the step change can be set smaller. The more copying operation is carried out, the thinner the membrane of the photosensitive layer of the drum 1 becomes. Thereby, the voltage which the photosensitive layer can endure becomes lower. Thus, the count of copied sheets by the copy sheet counter is renewed when the photosensitive drum 1 is changed to a new one, and as the number of copied sheets is increasing, the upper limit of the step number N becomes smaller.

Figure 15:
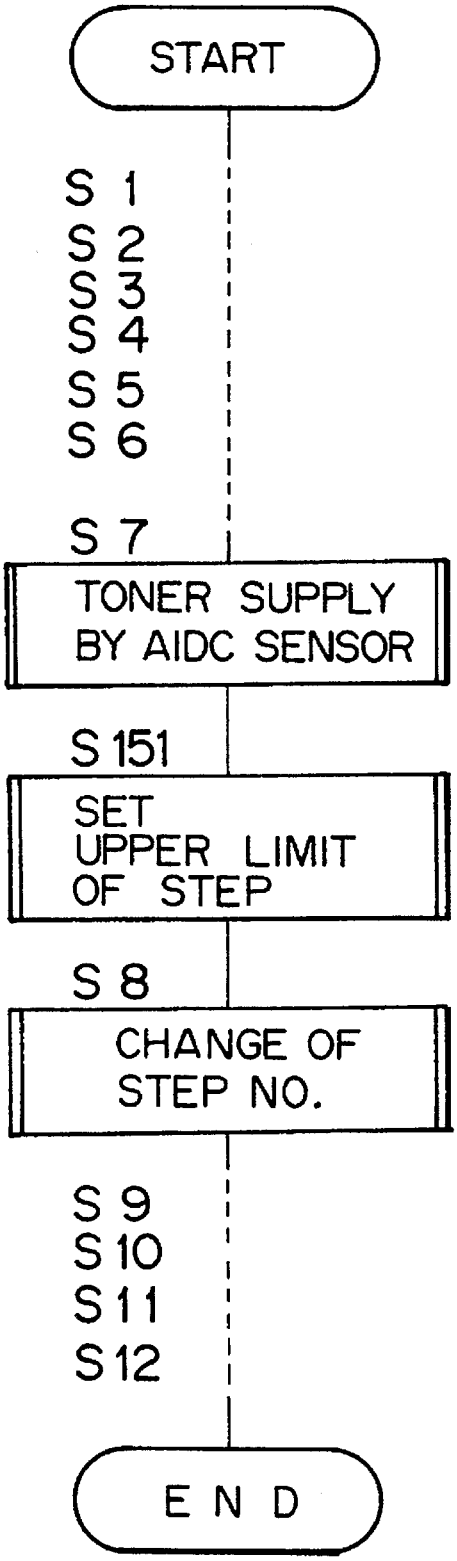
FIG. 15 is a flow chart which shows another example of the main routine of the control procedure carried out by the CPU.
Figure 16:
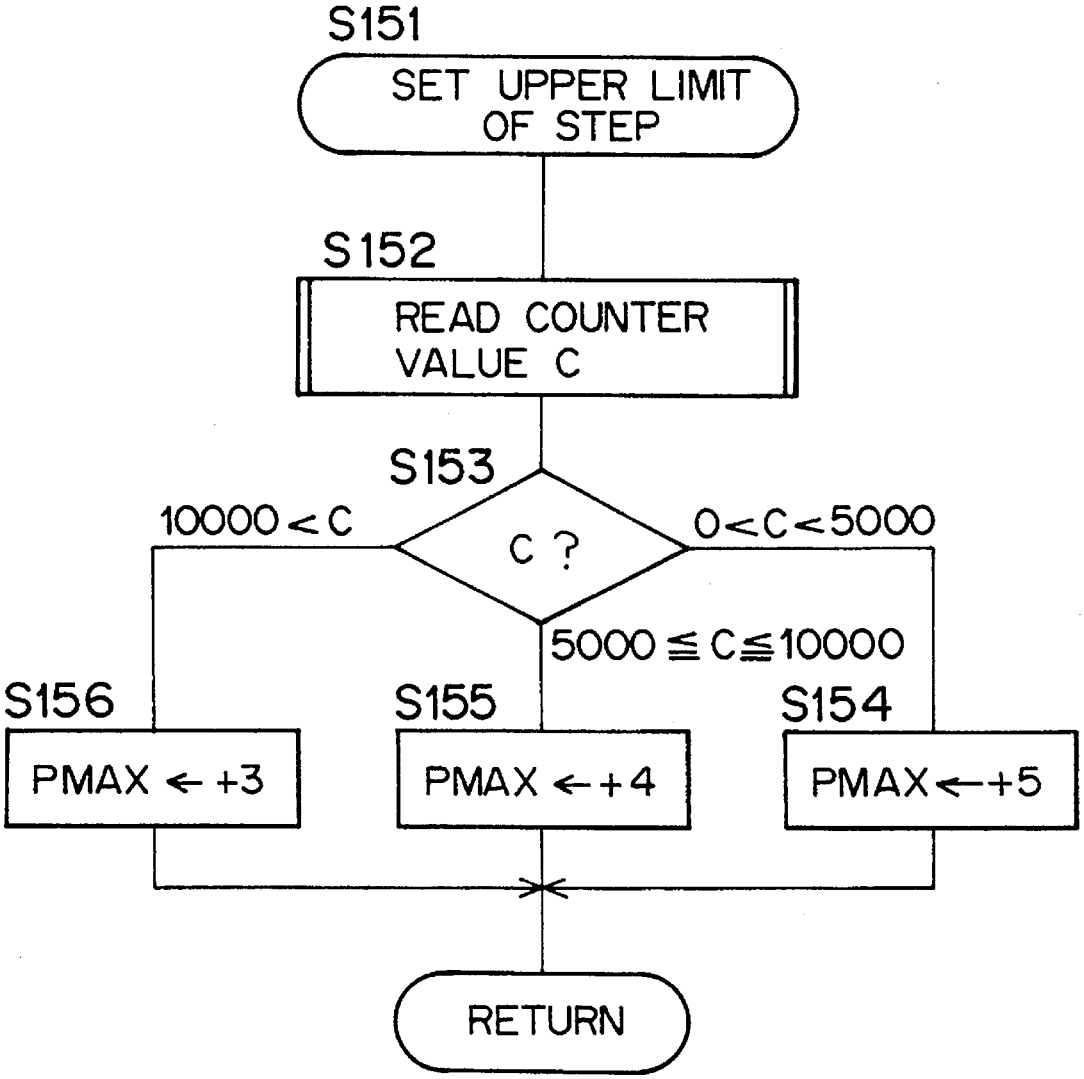
FIG. 16 is a flow chart which shows a subroutine of setting an upper limit of step.

FIG. 15 shows such a procedure. In this procedure, after the toner supply at step S7, a processing for setting the upper limit step is inserted. More specifically, as shown in FIG. 16, the value C of the copy sheet counter is read at step S152, and a set value of the upper limit step is judged according to the count value C at step S153. When the count value C is between 0 and 5000, the upper limit of step number PMAX is set at 5. When the count value C is between 5000 and 10000, the upper limit of step number PMAX is set at 4. When the count value C is more than 10000, the upper limit of step number PMAX is set at 3.

The charged grid voltage at the upper limit step number PMAX which is set by the above control is set according to the maximum charge on the photosensitive drum 1 which is estimated from the number of copy sheets at that time. As explained, though the membrane of the photosensitive layer becomes thinner, the grid voltage is always set smaller than the endurable highest voltage of the photosensitive drum, and thus, a pinhole formed on the photosensitive layer can be prevented.

Further, it is important to assume the case when the sensors 9 and 13 are out of order. When the sensors 9 and 13 are out of order for some reason, the output voltages of the sensors 9 and 13 become 0 V. The characteristic of the output voltage is shown in FIGS. 2 and 3. In the above-explained control, when the output voltage of the ATDC sensor 9 is 0 V, the toner density in the developer is Judged very high. If this condition continues, every time the density of the test pattern which is detected by the AIDC sensor 13 is judged low, the step number N is increased by one. However, such control is not the subject of the present invention. Also, when the output voltage of the AIDC sensor 13 is 0 V, the density of the test pattern is Judged high. Accordingly, the toner supply is not carried out, and thus, the toner density is extraordinarily lowered.

Figure 17:
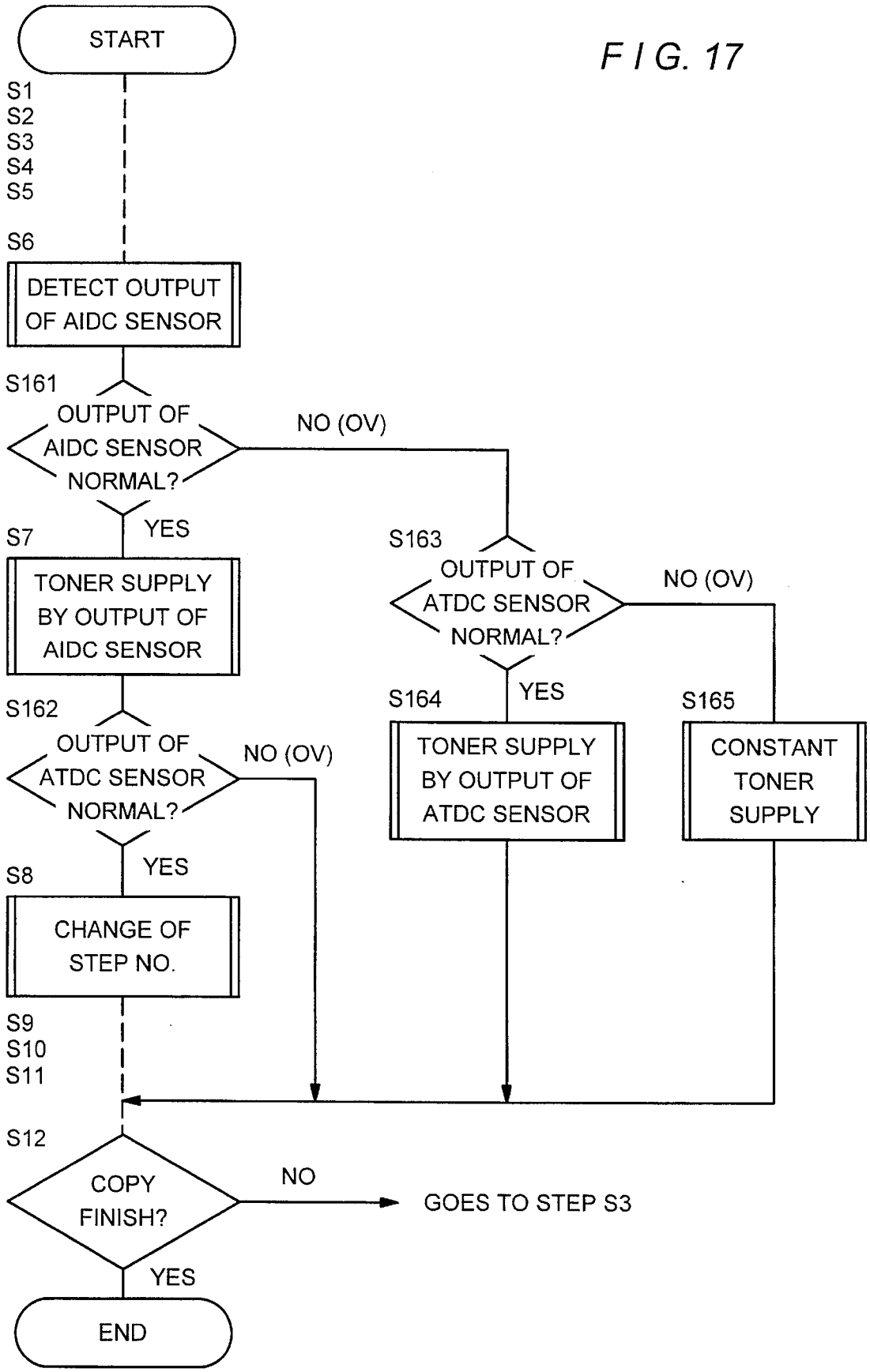
FIG. 17 is a flow chart which shows another example of the main routine of the control procedure carried out by the CPU.

Therefore, when the output voltages of the sensors 9 and 13 are 0 V, it is judged that the sensors 9 and 13 are out of order, and the control shown in FIG. 17 is carried out. After detecting the output voltage of the AIDC sensor 13 at step S6, the output voltage is Judged whether it is normal or not at step S161. If the output voltage is normal (if the output voltage is not 0 V), the toner is supplied at step S7. Next, whether the output voltage of the ATDC sensor 9 is normal or not is judged at step S162. If the output voltage is normal (the output voltage is not 0 V), the change of the step number N is carried out at step S8, and the operations at steps S9, S10 and S12 are carried out. If it is not normal (the output voltage is 0 V), steps S8 through S11 are skipped and the operation goes to step S12. In this case, the toner density is controlled according to only the detected result of the AIDC sensor 13.

On the other hand, if the output voltage of the AIDC sensor 13 is judged abnormal (the output voltage is 0 V) at step S161, whether the output voltage of the ATDC sensor 9 is normal or not is judged at step S163. If the output voltage is normal, the toner is supplied according to the detected output of the ATDC sensor 9 at step S164. In this toner supply control, the toner density in the developer is controlled according to the detected output of the sensor 9 in order to maintain the specified value. If the output voltage of the ATDC sensor 9 is judged abnormal at step S163, both the sensors 9 and 13 are abnormal, and a specified amount of toner which is determined beforehand is supplied at step S165. In the above control, when the sensor 9 or the sensor 13 is out of order, the control is changed to the AIDC single control or the ATDC single control. Also, when both the sensors 9 and 13 are out of order, the control is changed to the constant toner supply in order to prevent extreme rise and fall of the toner density.

Also, it is possible that an appropriate warning is given when the sensors 9 and 13 are out of order.

Although the present invention has been described in connection with the preferred embodiments above, it is to be noted that various changes and modifications are apparent to a person skilled in the art. Such changes and modifications are to be understood as being within the scope of the present invention.

Particularly, the present invention can be applied to analog copying machines which project the original image directly onto the photosensitive drum, and also it can be widely applied to digital copying machines such as a machine which expresses a tone by changing an emission time of a laser diode and a machine which uses a laser beam with a binary light quantity.

What is claimed is:

1. An electrophotographic image forming apparatus which forms an electrostatic latent image on an image carrier, develops the electrostatic latent image and transfers the developed image onto a sheet, the electrophotographic image forming apparatus comprising:

developing means for developing an electrostatic latent image which is formed on the image carrier;

first detecting means for detecting an amount of deposited toner on a test pattern which is formed on the image carrier;

toner supply control means for controlling the toner supply according to a result which is detected by the first detecting means;

second detecting means for detecting a toner density in a developer of the developing means; and image forming condition changing means for changing an image forming condition by changing both a developing bias voltage and a charged voltage of the image carrier according to a result which is detected by the second detecting means.

2. An image forming apparatus as claimed in claim 1, wherein:

the toner supply control means compares the result which is detected by the first detecting means to a first standard density, and supplies toner when the detected result is lower than the first standard density; and the image forming condition changing means compares a result which is detected by the second detecting means to a second standard density, and when the detected result is higher than the second standard density, the image forming condition is changed to increase a developing efficiency, and if the detected result is lower than the second standard density, the image density is changed to decrease a developing efficiency.

3. An image forming apparatus as claimed in claim 2, wherein when the result which is detected by the second detecting means is higher than the second standard density, the image forming condition is changed to increase the developing efficiency if the result which is detected by the first detecting means is lower than the first standard density, and when the result which is detected by the second detecting means is lower than the second standard density, the image forming condition is changed to decrease the developing efficiency if the result which is detected by the first detecting means is higher than the first standard density.

4. The image forming apparatus as claimed in claim 3, wherein the second standard density includes a range of density values.

5. The image forming apparatus as claimed in claim 4, wherein the second standard density includes a range of density values.

6. The image forming apparatus as claimed in claim 3, wherein the first standard density includes a range of density values.

7. The image forming apparatus as claimed in claim 2, wherein the first standard density includes a range of density values.

8. The image forming apparatus as claimed in claim 7, wherein the second standard density includes a range of density values.

9. The image forming apparatus as claimed in claim 2, wherein the second standard density includes a range of density values.

10. An image forming apparatus as claimed in claim 1, wherein the image forming condition changing means changes a $\gamma$ correction when the image forming condition is changed.

11. An electrophotographic image forming apparatus which forms an electrostatic latent image on an image carrier, develops the electrostatic latent image and transfers the developed image onto a sheet, the electrophotographic image forming apparatus comprising;

developing means for developing an electrostatic latent image which is formed on the image carrier;

first detecting means for detecting an amount of deposited toner on a test pattern which is formed on the image carrier;

toner supply control means for controlling the toner supply according to a result which is detected by the first detecting means;

second detecting means for detecting a toner density in a developer of the developing means; and image forming condition changing means for changing an image forming condition according to a result which is detected by the second detecting means;

wherein the toner supply control means compares the result which is detected by the first detecting means and a first standard density, and supplies toner when the detected result is lower than the first standard density; and the image forming condition changing means compares a result which is detected by the second detecting means and to a second standard density and when the result which is detected by the second detecting means is higher than the second standard density, the image forming condition is changed to increase the developing efficiency if the result which is detected by the first detecting means is lower than the first standard density, and when the result which is detected by the second detecting means is lower than the second standard density, the image forming condition is changed to decrease the developing efficiency if the result which is detected by the first detecting means is higher than the first standard density.

12. An image forming apparatus as claimed in claim 11, wherein the image forming condition to be changed is a developing bias voltage.

13. An image forming apparatus as claimed in claim 11, wherein the image forming condition to be changed is a charged voltage of the image carrier.

14. An image forming apparatus as claimed in claim 11, wherein the image forming condition to be changed is an amount of exposure of the image carrier.

15. The image forming apparatus as claimed in claim 11, wherein the first standard density includes a range of density values.

16. The image forming apparatus as claimed in claim 15, wherein the second standard density includes a range of density values.

17. The image forming apparatus as claimed in claim 11, wherein the second standard density includes a range of density values.

18. An image forming apparatus as claimed in claim 11, wherein the image forming condition changing means changes a $\gamma$ correction when the image forming condition is changed.

* * * * *